US009964345B2

(12) United States Patent
Vie et al.

(10) Patent No.: US 9,964,345 B2
(45) Date of Patent: May 8, 2018

(54) HEAT PUMP CONTROLLER WITH USER-SELECTABLE DEFROST MODES AND REVERSING VALVE ENERGIZING MODES

(71) Applicant: Emerson Electric Co., St. Louis, MO (US)

(72) Inventors: David L. Vie, Union, MO (US); Timothy B. Edwards, Eureka, MO (US)

(73) Assignee: Emerson Electric Co., St. Louis, MO (US)

( * ) Notice: Subject to any disclaimer, the term of this patent is extended or adjusted under 35 U.S.C. 154(b) by 417 days.

(21) Appl. No.: 14/155,575

(22) Filed: Jan. 15, 2014

(65) Prior Publication Data

US 2015/0184921 A1 Jul. 2, 2015

Related U.S. Application Data

(60) Provisional application No. 61/920,994, filed on Dec. 26, 2013.

(51) Int. Cl.
*F25D 21/00* (2006.01)
*F25B 30/02* (2006.01)
(Continued)

(52) U.S. Cl.
CPC ..... *F25B 30/02* (2013.01); *F25B 41/046* (2013.01); *F25B 47/025* (2013.01); *F25B 49/00* (2013.01); *F25B 49/02* (2013.01); *F25D 21/004* (2013.01); *F25D 21/006* (2013.01); *F25D 21/008* (2013.01); *F25B 13/00* (2013.01); *F25B 2500/19* (2013.01); *F25B 2600/01* (2013.01); *F25B 2600/027* (2013.01); *F25B 2600/11* (2013.01); *F25B 2600/23* (2013.01); *F25B 2700/193* (2013.01);
(Continued)

(58) Field of Classification Search
CPC ..... F25B 47/025; F25B 30/02; F25B 13/00; F25B 2700/2106; F25B 41/046; F25D 21/006
See application file for complete search history.

(56) References Cited

U.S. PATENT DOCUMENTS 4,163,129 A 7/1979 Rossi et al.
4,266,405 A 5/1981 Trask
(Continued)

FOREIGN PATENT DOCUMENTS

EP 1926075 B1 1/2013

OTHER PUBLICATIONS

"47D40-801 Demand Defrost Control Installation Instructions"; http://www.emersonclimate.com/Documents/White-Rodgers/instruction_sheets/0037-7200.pdf, accessed Oct. 11, 2013.
(Continued)

*Primary Examiner* — Kun Kai Ma
(74) *Attorney, Agent, or Firm* — Armstrong Teasdale LLP

(57) ABSTRACT

A heat pump controller for use in a heat exchange system includes a computing device and a user interface coupled to the computing device. The computing device is configured to initiate a defrost cycle based on one of a plurality of user-selectable defrost modes, and the user interface is configured to display the user-selectable defrost modes and receive a user selection corresponding to one of the user-selectable defrost modes.

21 Claims, 4 Drawing Sheets

(51) Int. Cl.

| | |
|---|---|
| ***F25B 41/04*** | (2006.01) |
| ***F25B 49/02*** | (2006.01) |
| ***F25B 49/00*** | (2006.01) |
| ***F25B 47/02*** | (2006.01) |
| *F25B 13/00* | (2006.01) |

(52) U.S. Cl.
CPC ..... *F25B 2700/2103* (2013.01); *F25B 2700/2106* (2013.01); *F25B 2700/2117* (2013.01); *Y10T 29/49716* (2015.01)

(56) References Cited

U.S. PATENT DOCUMENTS 4,318,425 A 3/1982 Marks
4,346,564 A 8/1982 Gemma et al.
4,373,349 A 2/1983 Mueller
4,407,138 A * 10/1983 Mueller ..... F25D 21/006 62/126
4,417,452 A 11/1983 Ruminsky et al.
4,498,310 A 2/1985 Imanishi et al.
4,510,765 A 4/1985 Rossi
4,538,420 A 9/1985 Nelson
4,653,285 A 3/1987 Pohl
4,724,678 A 2/1988 Pohl
4,881,057 A 11/1989 Garcia et al.
4,882,908 A * 11/1989 White ..... F25B 13/00 165/233
4,916,912 A 4/1990 Levine et al.
4,974,417 A 12/1990 Levine et al.
5,038,575 A 8/1991 Yamada
5,043,692 A 8/1991 Sites et al.
5,065,593 A 11/1991 Dudley et al.
5,237,830 A 8/1993 Grant
5,454,641 A 10/1995 Parker et al.
5,507,154 A * 4/1996 Grant ..... F25D 21/006 62/151
5,515,689 A 5/1996 Atterbury
5,692,385 A 12/1997 Hollenbeck et al.
5,707,151 A 1/1998 Parker et al.
5,872,721 A 2/1999 Huston et al.
6,207,967 B1 3/2001 Hochstein
6,622,503 B1 9/2003 Bennett et al.
6,951,306 B2 10/2005 Deluca
7,020,543 B1 3/2006 Jaeschke et al.
7,152,806 B1 12/2006 Rosen
7,245,475 B2 7/2007 Huber et al.
7,296,426 B2 11/2007 Butler et al.
7,454,269 B1 11/2008 Dushane et al.
7,614,567 B2 11/2009 Chapman, Jr. et al.
7,664,575 B2 2/2010 Boydstun et al.
7,784,291 B2 8/2010 Butler et al.
7,999,789 B2 8/2011 Ha et al.
8,078,326 B2 12/2011 Harrod et al.
8,389,916 B2 3/2013 Ben-Shmuel et al.
2002/0152298 A1 10/2002 Kikta et al.
2002/0163436 A1* 11/2002 Singh ..... A23G 9/00 340/584
2003/0041605 A1 3/2003 Butcher et al.
2004/0217182 A1 11/2004 St. Jean et al.
2004/0220777 A1 11/2004 St. Jean et al.
2004/0230402 A1 11/2004 St. Jean
2005/0194456 A1 9/2005 Tessier et al.
2006/0218946 A1* 10/2006 Davern ..... F25D 21/08 62/155
2007/0012052 A1 1/2007 Butler et al.
2007/0052547 A1 3/2007 Haughawout et al.
2007/0157642 A1 7/2007 Ferragut, II et al.
2007/0209380 A1* 9/2007 Mueller ..... F25B 47/025 62/260
2008/0073440 A1 3/2008 Butler et al.
2009/0000315 A1* 1/2009 Billman ..... A23G 9/28 62/73
2009/0088902 A1 4/2009 Williams
2013/0145460 A1* 6/2013 Dudley ..... F25D 29/003 726/21
2013/0340452 A1* 12/2013 Kleman ..... F25B 41/043 62/115
2014/0090406 A1* 4/2014 Ishikawa ..... F25B 47/02 62/82
2014/0150479 A1* 6/2014 Qu ..... F25D 21/008 62/80
2014/0207289 A1* 7/2014 Golden ..... G06F 3/0484 700/276
2015/0047375 A1* 2/2015 Qu ..... F25D 21/004 62/80
2015/0083812 A1* 3/2015 McDowell ..... G05D 23/1932 236/1 C
2015/0143825 A1* 5/2015 Qu ..... F25D 21/004 62/80
2015/0184920 A1 7/2015 Vie et al.

OTHER PUBLICATIONS

"47D43-811 Deluxe Defrost Control Installation Instructions"; http://www.emersonclimate.com/Documents/White-Rodgers/instruction_sheets/0037-7199.pdf, accessed Oct. 11, 2013.
http://www.kehongled.com/English/Products/LEDDisplays.html; Accessed and printed Jun. 28, 2012.
http://kehongled.en.alibaba.com/productshowimg/265049411-210046929/16_segment_graphic_LED_Display.html; Accessed and printed Jun. 28, 2012.
"Multi-digit LED Seven Segment Display"; www.snowdragonledhk.com; ©2007-2013; 2 pgs.

* cited by examiner

HEAT PUMP CONTROLLER WITH USER-SELECTABLE DEFROST MODES AND REVERSING VALVE ENERGIZING MODES

CROSS-REFERENCE TO RELATED APPLICATIONS

This application claims the benefit of U.S. Provisional Application No. 61/920,994, filed Dec. 26, 2013, the disclosure of which is hereby incorporated by reference in its entirety.

FIELD

The field of the disclosure relates generally to heat exchange systems, and more particularly, to heat pump controllers for use in controlling defrost cycles of heat exchange systems.

BACKGROUND

Heat exchange systems generally use a refrigerant to carry thermal energy between a temperature controlled environment and an ambient environment. Such systems generally include an external heat exchanger coil, an expansion valve, an internal heat exchanger coil, and a compressor, each fluidly connected to one another. In some heat exchange systems, the direction of refrigerant flow is reversible such that the heat exchange system can be used for either heating or cooling the temperature controlled environment.

Under certain operating conditions, moisture present in the ambient environment may freeze and accumulate on the external heat exchanger coil, and thereby reduce the efficiency of the heat exchange system. As a result, many heat exchange systems include a defrost controller configured to initiate a defrost cycle in the heat exchange system and melt the ice accumulated on the external heat exchanger coil. Some known heat exchange systems use a reversing valve to reverse the direction of refrigerant flow during the defrost cycle to flow relatively high temperature refrigerant through the external heat exchanger coil and melt the ice accumulated thereon.

Heat exchange systems manufactured by different heat exchange system manufacturers typically have different defrost modes, different reversing valve energizing modes, and/or other different settings which control operation of the heat exchange system. Known defrost controllers do not provide sufficient operability between heat exchange systems manufactured by different heat exchange system manufacturers. As a result, when a defrost controller in a heat exchange system needs to be replaced, the defrost controller is typically replaced with the same type of defrost controller used by the original heat exchange system manufacturer. Heat exchange system servicers are therefore required to stock numerous different defrost controllers, and also carry numerous different defrost controllers when servicing heat exchange systems. Suppliers of heat exchange system servicers similarly stock numerous different defrost controllers to meet the demands of the heat exchange system servicers. Accordingly, a need exists for a more satisfactory defrost controller.

This Background section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

In one aspect, a heat pump controller for use in a heat exchange system is provided. The heat exchange system includes an external heat exchanger, a compressor, a reversing valve, and an internal heat exchanger in fluid communication with one another. The heat pump controller includes a computing device and a user interface coupled to the computing device. The computing device is configured to initiate a defrost cycle based on one of a plurality of user-selectable defrost modes. The user interface is configured to display the user-selectable defrost modes and receive a user selection corresponding to one of the user-selectable defrost modes.

In another aspect, a method of installing a heat pump controller in a heat exchange system is provided. The heat exchange system includes an external heat exchanger, a compressor, a reversing valve, and an internal heat exchanger in fluid communication with one another. The heat pump controller includes a computing device coupled to a user interface. The method includes coupling the computing device to the reversing valve, and selecting, using the user interface, one of a plurality of user-selectable defrost modes for determining when to initiate a defrost cycle.

In yet another aspect, a heat pump controller for use in a heat exchange system is provided. The heat exchange system includes an external heat exchanger, a compressor, a reversing valve, and an internal heat exchanger in fluid communication with one another. The heat pump controller includes a first input, a second input connector, and a computing device. The first input connector is configured to be coupled to a first sensor for receiving a first signal from the first sensor. The second input connector is configured to be selectively coupled to a second sensor for selectively receiving a second signal from the second sensor. The computing device is configured to initiate a defrost cycle, and is selectively configurable between a plurality of defrost modes including a first defrost mode and a second defrost mode. In the first defrost mode, the computing device initiates the defrost cycle based on the first signal received from the first sensor and a period of time. In the second defrost mode, the computing device initiates the defrost cycle based on at least the second signal received from the second sensor.

In yet another aspect, a method of installing a heat pump controller in a heat exchange system is provided. The heat exchange system includes an external heat exchanger, a compressor, a reversing valve, and an internal heat exchanger in fluid communication with one another. The heat pump controller includes a first input connector, a second input connector, an output connector, and a computing device coupled to the first input connector, the second input connector, and the output connector. The method includes coupling the first input connector to a first sensor, coupling the output connector to the reversing valve, and selecting between one of a plurality of defrost modes including a first defrost mode and a second defrost mode. In the first defrost mode, the computing device initiates a defrost cycle based on a first signal received from the first sensor and a period of time. In the second defrost mode, the computing device initiates a defrost cycle based on at least a second signal received from a second sensor.

In yet another aspect, a heat pump controller for use in a heat exchange system is provided. The heat exchange system includes an external heat exchanger, a compressor, a reversing valve, and an internal heat exchanger in fluid communication with one another. The heat pump controller includes a first input connector, a second input connector, an output connector, and a computing device. The first input connector is configured to be coupled to a first sensor for receiving a first signal from the first sensor. The second input connector is configured to be selectively coupled to a second sensor for selectively receiving a second signal from the second sensor. The output connector is configured to be coupled to the reversing valve. The computing device is configured to initiate a defrost cycle. The heat pump controller is configured to operate with at least two types of heat exchange systems.

In yet another aspect, a method of replacing a heat pump controller in a heat exchange system manufactured by a heat exchange system manufacturer is provided. The heat exchange system includes an external heat exchanger, a compressor, a reversing valve, and an internal heat exchanger in fluid communication with one another. The method includes removing a first heat pump controller from the heat exchange system, and replacing the first heat pump controller with a second heat pump controller without regard to the heat exchange system manufacturer. The second heat pump controller includes a computing device selectively configurable between a plurality of defrost modes including a first defrost mode and a second defrost mode.

In yet another aspect, a method of replacing a heat pump controller in a heat exchange system manufactured by a heat exchange system manufacturer is provided. The heat exchange system includes an external heat exchanger, a compressor, a reversing valve, and an internal heat exchanger in fluid communication with one another. The method includes removing a first heat pump controller from the heat exchange system, and replacing the first heat pump controller with a second heat pump controller without regard to the heat exchange system manufacturer. Replacing the first heat pump controller includes coupling the second heat pump controller to the reversing valve. The second heat pump controller includes a computing device selectively configurable between a first reversing valve energizing mode and a second reversing valve energizing mode.

In yet another aspect, a heat pump controller for use in a heat exchange system is provided. The heat exchange system includes an external heat exchanger, a compressor, a reversing valve, and an internal heat exchanger in fluid communication with one another. The heat pump controller includes a computing device and a user interface coupled to the computing device. The computing device is configured to output an energizing signal to the reversing valve while the heat exchange system is in one of a heating mode or a cooling mode based on one of a plurality of user-selectable reversing valve energizing modes. The user interface is configured to display the user-selectable reversing valve energizing modes, and receive a user selection corresponding to one of the user-selectable reversing valve energizing modes.

In yet another aspect, a method of installing a heat pump controller in a heat exchange system is provided. The heat exchange system includes an external heat exchanger, a compressor, a reversing valve, and an internal heat exchanger in fluid communication with one another. The heat pump controller includes a computing device coupled to a user interface. The method includes coupling the computing device to the reversing valve, and selecting, using the user interface, one of a plurality of user-selectable reversing valve energizing modes.

In yet another aspect, a heat pump controller for use in a heat exchange system is provided. The heat exchange system includes an external heat exchanger, a compressor, a reversing valve, and an internal heat exchanger in fluid communication with one another. The heat pump controller includes an output connector and a computing device. The output connector is configured to be coupled to the reversing valve. The computing device is configured to output an energizing signal to the reversing valve via the output connector to actuate the reversing valve and initiate or terminate a defrost cycle. The computing device is selectively configurable between a first energizing mode and a second energizing mode.

In yet another aspect, a method of installing a heat pump controller in a heat exchange system is provided. The heat exchange system includes an external heat exchanger, a compressor, a reversing valve, and an internal heat exchanger in fluid communication with one another. The heat pump controller includes a first input connector, a second input connector, an output connector, and a computing device coupled to the first input connector, the second input connector, and the output connector. The method includes coupling the first input connector to a first sensor, coupling the output connector to the reversing valve, and selecting between one of a first energizing mode and a second energizing mode. In the first energizing mode, the computing device outputs an energizing signal to the reversing valve when the heat exchange system is in a heating mode, and in the second energizing mode the computing device outputs an energizing signal to the reversing valve when the heat exchange system is in a cooling mode.

Various refinements exist of the features noted in relation to the above-mentioned aspects. Further features may also be incorporated in the above-mentioned aspects as well. These refinements and additional features may exist individually or in any combination. For instance, various features discussed below in relation to any of the illustrated embodiments may be incorporated into any of the above-described aspects, alone or in any combination.

DETAILED DESCRIPTION

Figure 1:
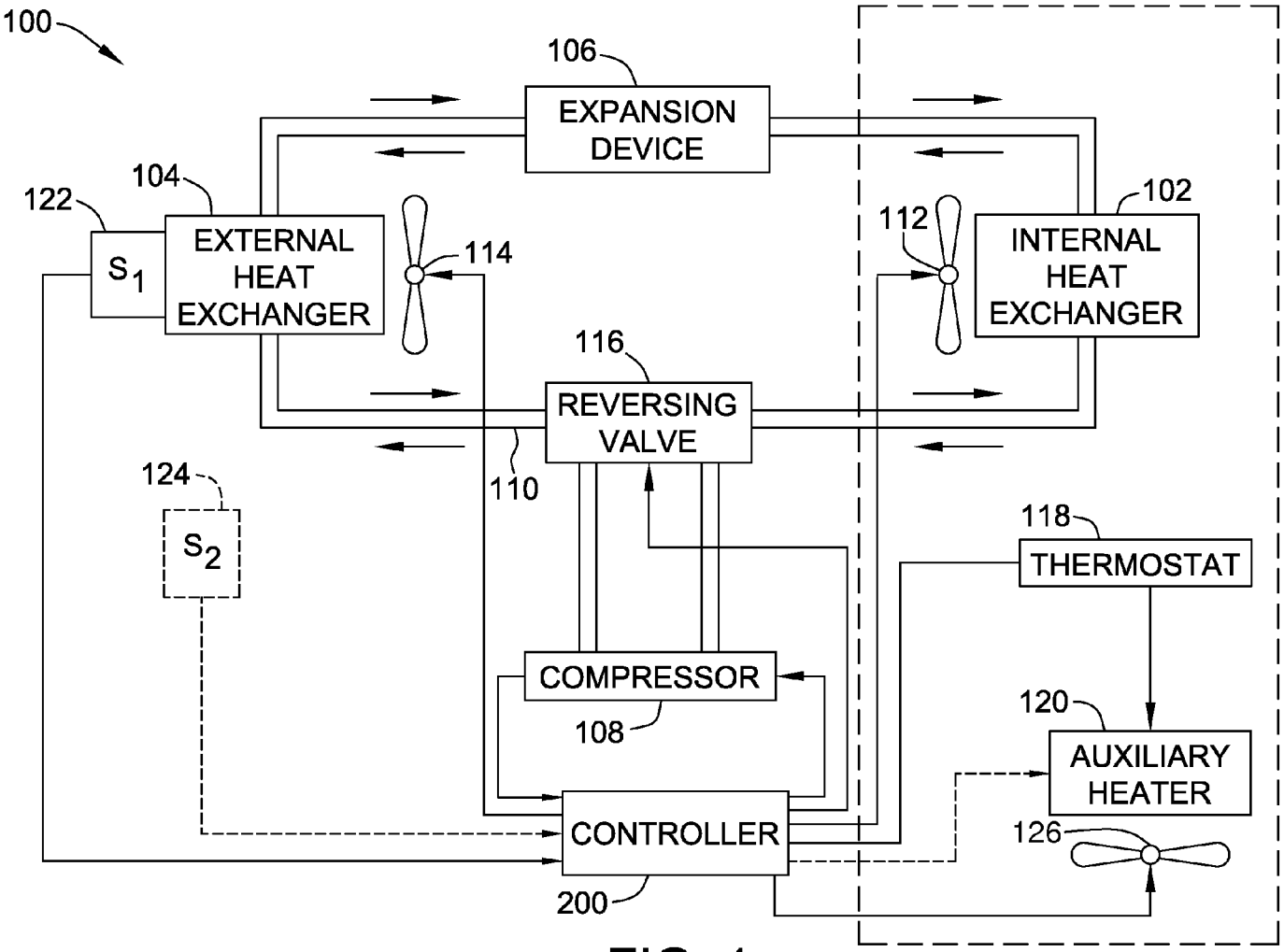
FIG. 1 is a schematic diagram of a heat exchange system including a heat pump controller.

Referring to FIG. 1, a heat exchange system of one embodiment for heating and cooling a temperature controlled environment is indicated generally at 100. The heat exchange system 100 generally includes an internal heat exchanger 102, an external heat exchanger 104, an expansion device 106 fluidly connected between the heat exchangers 102, 104, and a compressor 108. The external heat exchanger 104, the expansion valve 106, the internal heat exchanger 102, and the compressor 108 are connected in fluid communication by conduits 110.

Refrigerant is circulated through the system 100 by the compressor 108. An internal blower 112 forces air from the temperature controlled environment into contact with the internal heat exchanger 102 to exchange heat between the refrigerant and the temperature controlled environment. The internal blower 112 subsequently forces the air back into the temperature controlled environment. Similarly, an external blower 114 forces air from an ambient environment into contact with the external heat exchanger 104, and subsequently back into the ambient environment. The direction of refrigerant flow is controlled by a reversing valve 116 fluidly connected between the compressor 108 and each heat exchanger 102, 104.

The operation of the system 100 is generally controlled by a heat pump controller 200 and a thermostat 118 coupled to the heat pump controller 200. The thermostat 118 is coupled to one or more temperature sensors (not shown) for measuring the temperature of the temperature controlled environment. The heat pump controller 200 is coupled to the reversing valve 116, the compressor 108, and the blowers 112, 114 for controlling operation of the components in response to control signals received from the thermostat 118 and for controlling operation of the components during defrost cycles.

The system 100 also includes an auxiliary heater 120 coupled to the controller 200 and the thermostat 118. The auxiliary heater 120 is configured to supply additional heat to the system 100 when the system is in a heating mode and/or to supply heat to the temperature controlled environment when the system 100 is in a defrost mode. In alternative embodiments, the auxiliary heater 120 is omitted from the system 100.

The system 100 also includes sensors 122, 124 for monitoring environmental conditions of the system 100. Sensors 122, 124 are coupled to the controller 200 for relaying information about the system 100 to the controller 200 in the form of electrical signals. In the illustrated embodiment, sensors 122, 124 are temperature sensors, described in more detail below. The system 100 may include additional or alternative sensors, such as photo-optical sensors, pressure sensors, tactile sensors, and refrigerant pressure sensors.

In operation, the compressor 108 receives gaseous refrigerant that has absorbed heat from the environment of one of the two heat exchangers 102, 104. The gaseous refrigerant is compressed by the compressor 108 and discharged at high pressure and relatively high temperature to the other heat exchanger. Heat is transferred from the high pressure refrigerant to the environment of the other heat exchanger and the refrigerant condenses in the heat exchanger. The condensed refrigerant passes through the expansion device 106, and into the first heat exchanger where the refrigerant gains heat, is evaporated and returns to the compressor intake.

When the system 100 operates in a heating mode, refrigerant flowing through the external heat exchanger 104 is at a lower temperature than the ambient air. As a result, moisture present in the ambient environment may condense on the external heat exchanger 104. When the temperature of the external heat exchanger 104 is at or below a freezing temperature, the moisture in the ambient environment may freeze and ice may accumulate on the external heat exchanger 104, thereby reducing the efficiency of the heat exchange system 100.

The controller 200 is configured to initiate a defrost cycle in the system 100 in response to signals received from one or more sensors 122, 124. During the defrost cycle, the controller 200 communicates with the reversing valve 116 to reverse the flow of refrigerant within the system 100. Refrigerant having a relatively high temperature as compared to the ambient environment is flowed through the external heat exchanger 104 to melt the ice accumulated on the external heat exchanger 104. The external blower 114 is de-energized during the defrost cycle to facilitate defrosting the external heat exchanger 104.

During the defrost cycle, refrigerant flows in the same direction as it does during a cooling mode. As such, the heat exchange system 100 is considered to be operating in a "cooling mode" during a defrost cycle. To supply heat to the temperature controlled environment during a defrost cycle, the controller 200 energizes the auxiliary heater 120. An auxiliary heater blower 126 forces air from the temperature controlled environment into contact with the auxiliary heater 120 and back into the temperature controlled environment to supply heat to the temperature controlled environment during a defrost cycle. The illustrated heat exchange system 100 includes an auxiliary heater blower 126 separate from the internal blower 112. In alternative embodiments, the auxiliary heater blower 126 may be omitted, and the internal blower 112 may be configured to force air from the temperature controlled environment into contact with the auxiliary heater 120 and back into the temperature controlled environment.

The controller 200 subsequently terminates the defrost cycle upon a condition being satisfied (e.g., the elapsed time of a defrost cycle exceeding a pre-set time or the temperature of the external heat exchanger 104 reaching a threshold temperature) by communicating with reversing valve 116 and returning the refrigerant flow to its original flow path.

The illustrated heat exchange system 100 is configured to initiate a defrost cycle based upon the actual or likely accumulation of frost on the external heat exchanger 104, commonly referred to as a "demand defrost" heat exchange system. More specifically, the illustrated heat exchange system 100 includes two sensors 122, 124 coupled to the controller 200 configured to detect and/or monitor the accumulation of frost on the external heat exchanger 104. In the illustrated embodiment, the first sensor 122 is a temperature sensor configured to measure the temperature of the external heat exchanger 104 and the second sensor 124 is a temperature sensor configured to measure the temperature of the ambient air surrounding the external heat exchanger 104. The controller 200 is coupled to the first and second sensors 122, 124, and is configured to initiate a defrost cycle based on a temperature differential between the temperature of the external heat exchanger 104 and the ambient air temperature. In one embodiment, for example, the controller 200 initiates a defrost cycle when the temperature differential between the external heat exchanger 104 and the ambient air temperature exceeds a threshold temperature differential (e.g., 10 F), and the compressor run time exceeds a pre-set limit (e.g., 10 minutes). More specifically, when the temperature differential between the external heat exchanger 104 and the ambient air temperature exceeds a threshold temperature differential, the controller 200 measures the run time of the compressor 108. When the compressor run time exceeds a pre-set limit, the controller 200 initiates a defrost cycle by actuating the reversing valve 116 and reversing the flow of refrigerant in system 100.

It is contemplated that the controller 200 may be utilized in demand defrost heat exchange systems other than the heat exchange system 100 illustrated in FIG. 1. Alternative demand defrost systems may include any suitable number and any suitable type of sensors that enable the system to monitor or detect the accumulation of ice on the external heat exchanger 104. Examples of suitable sensors include, but are not limited to, photo-optical sensors, pressure sensors, and tactile sensors. Further, alternative demand defrost systems may be configured to initiate a defrost cycle based on conditions other than a temperature differential between the external heat exchanger and the ambient air, and a compressor run time.

The controller 200 of the present disclosure may be utilized in yet other heat exchange systems such as, for example, a "timed defrost" heat exchange system. Timed defrost heat exchange systems are configured to initiate a defrost cycle based upon an elapsed period of time, such as, for example, an elapsed compressor run time. Such systems may include at least one sensor, such as the first sensor 122, to measure the temperature of the external heat exchanger 104, and to initiate a defrost cycle only when the temperature of the external heat exchanger is below a threshold temperature (e.g., 320 F). In one embodiment of a timed defrost heat exchange system, the controller 200 initiates a defrost cycle if, after the compressor runs for a pre-determined time (e.g., 30 minutes), the temperature of the external heat exchanger 104 is below a threshold temperature (e.g., 32° F.).

Figure 2:
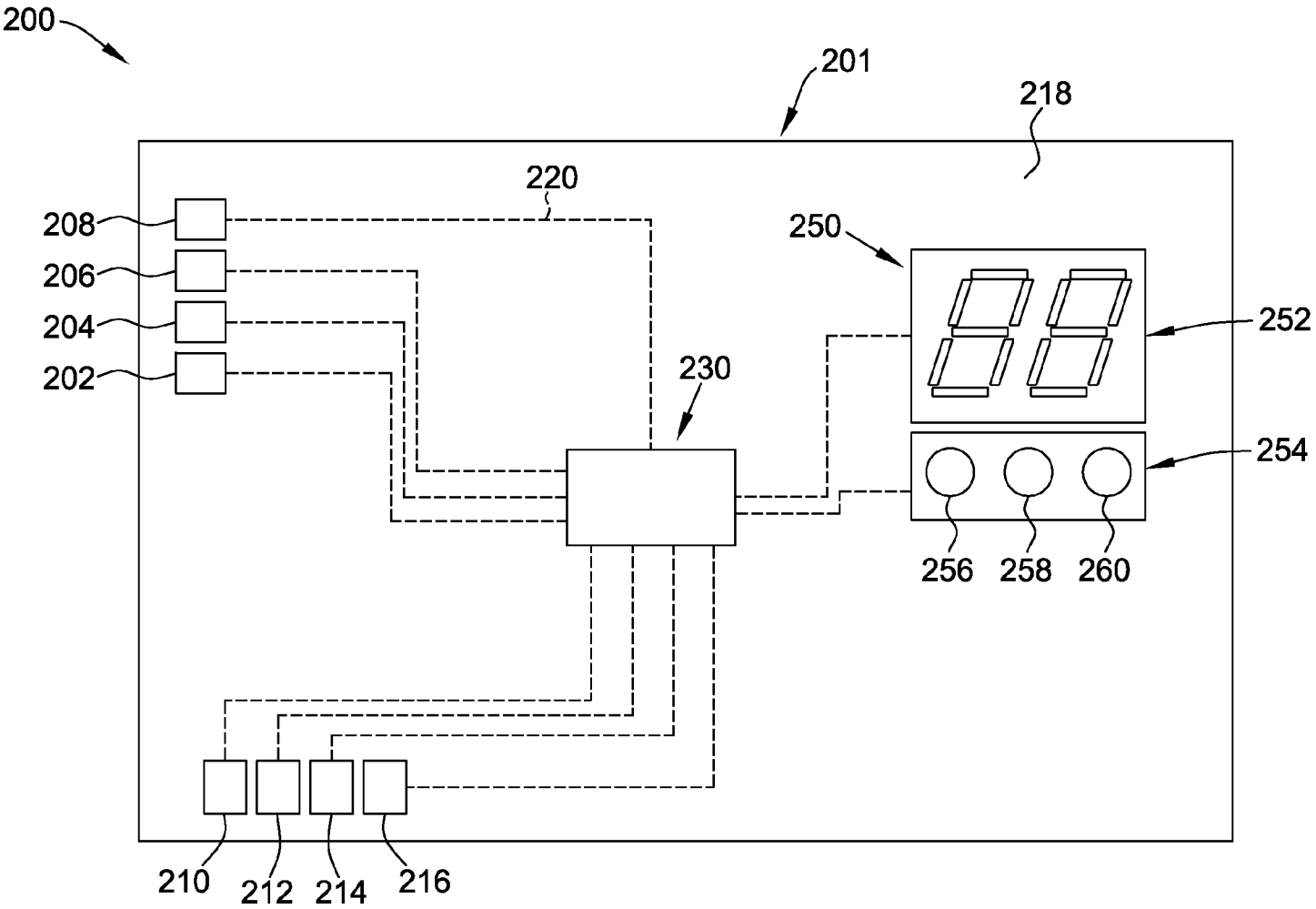
FIG. 2 is a schematic diagram of the heat pump controller of FIG. 1 including a computing device and a user interface.

Referring to FIG. 2, the controller 200 includes a single printed circuit board 201, a plurality of input connectors 202, 204, 206, 208, a plurality of output connectors 210, 212, 214, 216, a computing device 230, and a user interface 250. The controller 200 may also include a mounting tray (not shown) fabricated from plastic and a plurality of breakaway mounting tabs (not shown) to facilitate positioning and mounting the controller 200 within the heat exchange system 100.

The printed circuit board 201 includes a dielectric substrate 218 and a plurality of conductive interconnects 220 providing a network of electrical connections between the components coupled to the printed circuit board 201.

The input connectors 202, 204, 206, 208 are coupled to the printed circuit board 201, and are coupled to computing device 230 via the conductive interconnects 220. The input connectors 202, 204, 206, 208 are configured to receive signals from one or more components of the heat exchange system 100. The output connectors 210, 212, 214, 216 are also coupled to the printed circuit board 201, and are coupled to computing device 230 via the conductive interconnects 220. The output connectors 210, 212, 214, 216 are configured to output signals from the computing device 230 to one or more components of the heat exchange system 100.

In the illustrated embodiment, the input and output connectors 202, 204, 206, 208, 210, 212, 214, 216 are pin-type connectors, although the input and output connectors 202, 204, 206, 208, 210, 212, 214, 216 may include any suitable connector that enables the controller 200 to function as described herein, such as, for example, screw-type connectors, spade-type connectors, and combinations thereof.

The input connectors include a first input connector 202 configured to be coupled to the first sensor 122 for receiving a signal from the first sensor 122, and a second input connector 204 configured to be selectively coupled to the second sensor 124 for receiving a signal from the second sensor 124. The controller 200 may include additional input connectors 206, 208 configured to be coupled to additional sensors and/or other components of the system 100 for receiving signals from the additional sensors and/or the other components of the system 100. In one suitable embodiment, for example, the controller 200 includes an input connector configured to be coupled to a refrigerant pressure sensor (not shown) configured to measure the pressure of the refrigerant within the heat exchange system 100.

The output connectors include a reversing valve output connector 210, a compressor output connector 212, and an auxiliary heater output connector 214. The reversing valve output connector 210 is configured to be coupled to the reversing valve 116, and to output an energizing signal from the computing device 230 to the reversing valve 116 to initiate or terminate a defrost cycle. The compressor output connector 212 is configured to be coupled to the compressor 108, and to output a signal to the compressor 108 in response to a demand signal from the thermostat 118 and/or the computing device 230. The auxiliary heater output connector 214 is configured to be coupled to the auxiliary heater 120, and to output a signal to the auxiliary heater 120 from the computing device 230 (e.g., when the computing device 230 initiates a defrost cycle). The controller 200 may include additional output connectors 216 configured to be coupled, or coupled, to other components of the system 100 for outputting signals to the other components of the system 100.

The computing device 230 and the user interface 250 are both coupled to the printed circuit board 201. The user interface 250 is coupled to computing device 230, and includes a display device 252 and an input interface 254, described in more detail below with reference to FIG. 3.

Figure 3:
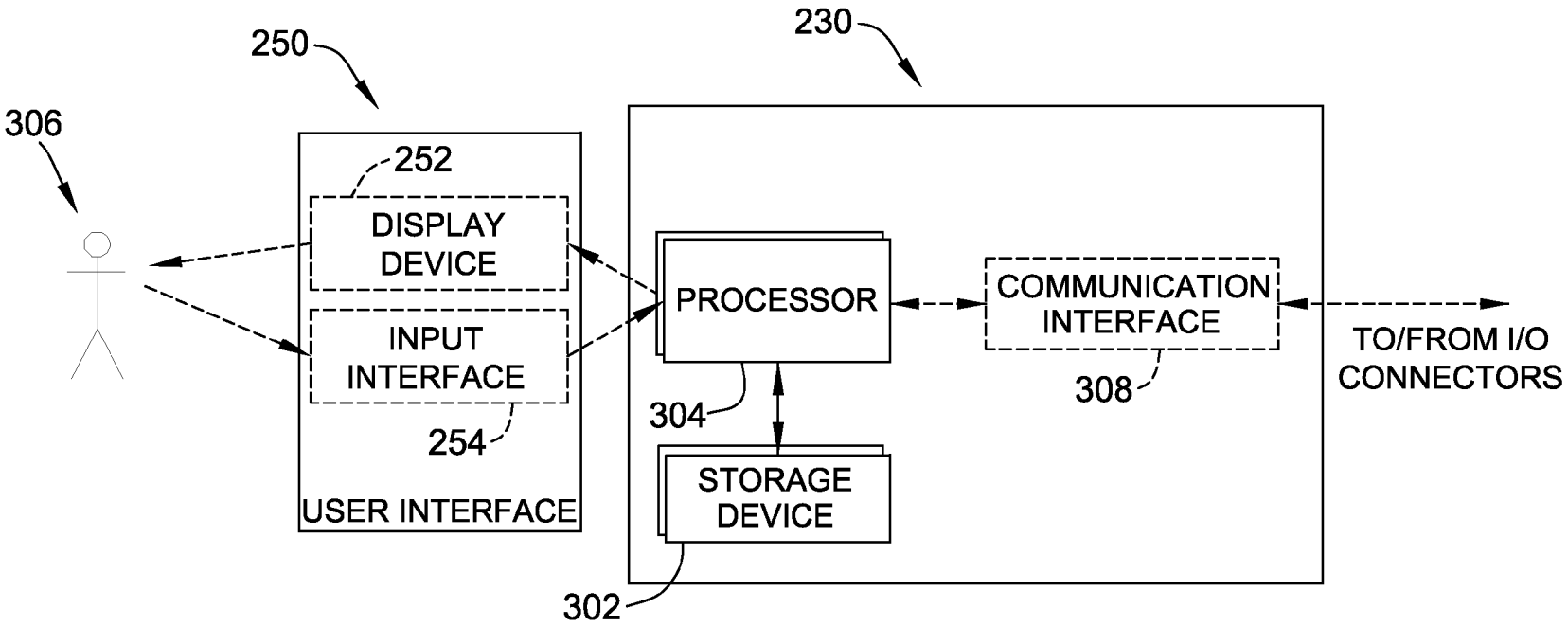
FIG. 3 is a block diagram of the computing device and the user interface of FIG. 2.

FIG. 3 is a block diagram of the computing device 230 and the user interface 250. The computing device 230 includes at least one computer-readable storage device 302 and a processor 304 that is coupled to the storage device 302 for executing instructions. In this embodiment, executable instructions are stored in the storage device 302, and the computing device 230 performs one or more operations described herein by programming the processor 304. For example, the processor 304 may be programmed by encoding an operation as one or more executable instructions and by providing the executable instructions in the storage device 302.

The processor 304 may include one or more processing units (e.g., in a multi-core configuration). Further, the processor 304 may be implemented using one or more heterogeneous processor systems in which a main processor is present with secondary processors on a single chip. As another illustrative example, the processor 304 may be a symmetric multi-processor system containing multiple processors of the same type. Further, the processor 304 may be implemented using any suitable programmable circuit including one or more systems and microcontrollers, microprocessors, programmable logic controllers (PLCs), reduced instruction set circuits (RISC), application specific integrated circuits (ASIC), programmable logic circuits, field programmable gate arrays (FPGA), and any other circuit capable of executing the functions described herein. Further, the processor 304 may include an internal clock to monitor the timing of certain events, such as a compressor run time. In the embodiment of the present disclosure, the processor 304 determines when to initiate a defrost cycle based on input signals received from one or more sensors as described herein. The processor 304 is also configured to control operation of the reversing valve 116 and the auxiliary heater 120.

The storage device 302 is one or more devices that enable information such as executable instructions and/or other data to be stored and retrieved. The storage device 302 may include one or more computer readable media, such as, without limitation, dynamic random access memory (DRAM), static random access memory (SRAM), a solid state disk, and/or a hard disk. The storage device 302 may be configured to store, without limitation, application source code, application object code, source code portions of interest, object code portions of interest, configuration data, execution events and/or any other type of data.

As noted above, the user interface 250 includes a display device (broadly, a presentation interface) 252 and an input interface 254. The display device 252 is coupled to the processor 304, and presents information, such as user-configurable settings, to a user 306, such as a technician. In the illustrated embodiment, the display device 252 includes a seven-segment liquid crystal display (LCD) (FIG. 2), although the display device 252 may include any suitable display device that enables the controller 200 to function as described herein, such as, for example, a cathode ray tube (CRT), a liquid crystal display (LCD), an organic LED (OLED) display, an LED matrix display, and/or an "electronic ink" display. Further, the display device 252 may include more than one display device. In this embodiment, the display device is configured to display user-configurable settings, a plurality of options corresponding to each user-configurable setting, and user-selectable pre-configurations of the user-configurable settings, described below.

In another suitable embodiment, the display device 252 includes a plurality individual light indicators (e.g., LEDs) each corresponding to one of the user-configurable settings, the plurality of options corresponding to the user-configurable setting, and/or the user-selectable pre-configurations of the user-configurable settings.

The input interface 254 is coupled to the processor 304 and is configured to receive input from the user 306. In the illustrated embodiment, the input interface 254 includes a plurality of push buttons 256, 258, 260 (FIG. 2) to receive input from the user 306. The push buttons 256 and 260 allow a user to cycle through user-configurable settings and user-selectable options corresponding to the user-configurable setting. The push button 258 allows a user to select a user-configurable setting and a user-selectable option corresponding to a user-configurable setting. In other embodiments, the input interface 254 may include any suitable input device that enables the controller 200 to function as described herein, such as, for example, a keyboard, a pointing device, a mouse, a stylus, a touch sensitive panel (e.g., a touch pad or a touch screen), a gyroscope, an accelerometer, a position detector, and/or an audio user input interface. A single component, such as a touch screen, may function as both the display device 252 and the input interface 254.

The computing device 230 further includes a communication interface 308 coupled to processor 304. The communication interface 308 is coupled to the input and output connectors 202, 204, 206, 208, 210, 212, 214, 216, and enables the processor 304 to communicate with one or more components of the system 100, such as first and second sensors 122, 124, via the input and output connectors 202, 204, 206, 208, 210, 212, 214, 216.

As noted above, the controller 200 of the present disclosure is configured to operate in different types of heat exchange systems. Specifically, the controller 200 is selectively configurable between a plurality of operating modes using the computing device 230 and the user interface 250 such that a technician may install the controller 200 in a variety of different heat exchange systems without regard to the heat exchange system manufacturer, and configure the controller 200 to operate with the heat exchange system in which the controller is installed.

In one embodiment, for example, the computing device 230 is selectively configurable between a plurality of user-selectable defrost modes. Suitable user-selectable defrost modes include, but are not limited to, a demand defrost mode and a timed defrost mode. The storage device 302 includes algorithms in the form of computer-executable instructions corresponding to the different defrost modes. The user interface 250 enables a user to select between the different defrost modes by displaying, using the display device 252, a visual indicator (e.g., an alphabetic or numeric character or a set of alphabetic or numeric characters) corresponding to each of the defrost modes, and receiving, using the input interface 254, a user selection corresponding to one of the user-selectable defrost modes. The computing device 230 (specifically, the processor 304) executes one of the algorithms corresponding to one of the defrost modes in response to the user-selection of a defrost mode made using the user interface 250. In the illustrated embodiment, the plurality of defrost modes are mutually exclusive defrost modes. That is, the computing device 230 is configured to operate in only one of the user-selectable defrost modes at a time.

In one embodiment of a demand defrost mode, the computing device 230 initiates a defrost cycle based upon a temperature differential between the external heat exchanger 104 and the ambient air temperature, and an elapsed compressor 108 run time.

In this embodiment, the computing device 230, and more specifically, the processor 304, receives a signal from the first sensor 122 corresponding to the temperature of the external heat exchanger 104. The processor 304 also receives a signal from the second sensor 124 corresponding to the temperature of the ambient air in which the external heat exchanger 104 is located. The processor 304 monitors the temperature differential between the external heat exchanger 104 and the ambient air temperature based on the signals received from the first and second sensors 122, 124. The processor 304 also monitors the running time of the compressor 108 when the heat exchange system 100 is in a heating mode. When the temperature differential between the external heat exchanger 104 and the ambient air temperature exceeds a threshold temperature differential value (broadly, a temperature condition) and the compressor run-time exceeds a threshold run-time value (broadly, a time condition), the processor 304 initiates a defrost cycle. To initiate the defrost cycle, the processor 304 outputs a signal to the reversing valve 116 to reverse the flow of refrigerant within the system 100.

The controller 200 is configured to terminate the defrost cycle by outputting a signal, using the processor 304, to the reversing valve 116 upon a subsequent condition being satisfied. The subsequent condition may be a temperature condition, a time condition, or any other suitable condition that enables the controller 200 to function as described herein. In one embodiment, for example, the processor 304 monitors the temperature of the external heat exchanger 104 based on the signal received from the first sensor 122, and terminates the defrost cycle when the external heat exchanger 104 temperature exceeds a threshold temperature value.

The threshold temperature differential value and/or the threshold run-time value for initiating a defrost cycle may be fixed values, or the values may be dependent on or more other values, such as the ambient air temperature. For example, the threshold temperature differential value and the threshold run-time value may be directly related to the ambient air temperature. That is, the threshold temperature differential value and threshold run-time value may be smaller at low ambient air temperatures, and larger at high ambient air temperatures.

In one embodiment, the controller 200 is configured to establish a baseline temperature differential threshold by initiating a "sacrificial" defrost cycle. The cycle is sometimes referred to as a sacrificial defrost cycle because the defrost cycle is initiated for the purpose of calibrating the controller 200, even though one or more conditions for initiating a defrost cycle may not be satisfied. More specifically, the controller 200 initiates a defrost cycle regardless of the environmental conditions of the system 100, and operates the system 100 in a defrost cycle for a sufficient time to ensure the external heat exchanger is free from ice accumulation. The controller 200 then determines a temperature differential between the ice-free external heat exchanger 104 and the ambient air temperature, and establishes a baseline temperature differential threshold based on the measured temperature differential.

The foregoing description of a demand defrost mode is merely one example. The controller 200 can be configured to operate in any other suitable demand defrost mode in addition to or as an alternative to the foregoing demand defrost mode. In one suitable embodiment, for example, the computing device 230 (and more specifically the processor 304) is configured to terminate a defrost cycle based upon a set time limit for the defrost cycle. In yet another suitable embodiment, the controller 200 is configured to initiate a defrost cycle based upon other inputs in addition to or in the alternative to the first and second temperature sensor inputs, such as additional temperature sensor inputs, a pressure sensor input, a photo-optical sensor input, or any other suitable input that enables the controller 200 to function as described herein.

In one embodiment of a timed defrost mode, the computing device 230 initiates a defrost cycle based upon the temperature of the external heat exchanger 104 and a period of time.

In this embodiment, the computing device 230, and more specifically, the processor 304, receives a signal from the first sensor 122 corresponding to the temperature of the external heat exchanger 104 when a time condition is satisfied. In one embodiment, the time condition is satisfied when the amount of time since the last defrost cycle was terminated exceeds a threshold time value. In another embodiment, the time condition is satisfied when the aggregate run time of the compressor since the last defrost cycle was terminated exceeds a threshold time value. If the temperature of the external heat exchanger 104 is below a threshold temperature value, the processor 304 initiates a defrost cycle by outputting a signal to the reversing valve 116 to reverse the flow of refrigerant within the system 100. If the temperature is not below the threshold temperature value, the processor 304 waits until the time condition is satisfied again before receiving another signal from the first sensor 122 corresponding to the temperature of the external heat exchanger 104.

The controller 200 is configured to terminate the defrost cycle by outputting a signal, using the processor 304, to the reversing valve 116 upon a subsequent condition being satisfied. The subsequent condition may be a temperature condition, a time condition, or any other suitable condition that enables the controller 200 to function as described herein. In one embodiment, for example, the processor 304 monitors the temperature of the external heat exchanger 104 based on the signal received from the first sensor 122, and terminates the defrost cycle when the external heat exchanger 104 temperature exceeds a threshold temperature value.

The foregoing description of the timed defrost mode is exemplary only. The controller 200 can be configured to operate in any other suitable timed defrost mode in addition to or as an alternative to the foregoing timed defrost mode. In one suitable embodiment, for example, the computing device 230 (and more specifically the processor 304) is configured to terminate a defrost cycle based upon a set time limit for the defrost cycle. In another suitable embodiment, the controller 200 is configured to initiate a defrost cycle based upon fixed time period (e.g., every 30 minutes) without regard to the external heat exchanger 104 temperature. Such a defrost mode is sometimes referred to as a "straight timed" defrost mode.

The controller 200 may also be configurable between other defrost modes in addition to or in the alternative to the above-described defrost modes, including, but not limited to, adaptive defrost modes. Adaptive defrost modes generally use information about the heat exchange system, such as past operating conditions and environmental conditions, to modify the algorithm used to determine when to initiate a defrost cycle. For example, in one embodiment of an adaptive defrost mode, the controller 200 (more specifically, the computing device 230), uses the elapsed time period from a previous defrost cycle to adjust the amount of time between subsequent defrost cycles such that the time period between defrost cycles is varied as a function of the length of the previous defrost cycle.

The controller 200 of the present disclosure is also selectively configurable between a plurality of reversing valve energizing modes including a cooling-mode reversing valve energizing mode and a heating-mode reversing valve energizing mode. Generally, heat exchange systems are configured to energize the reversing valve while operating in either the heating mode or the cooling mode, but not both. Some heat exchange systems are configured to energize the reversing valve in the heating mode (referred to herein as "heating-mode reversing valve energizing heat exchange systems"), and thus require a controller configured to send an energizing signal to the reversing valve when the heat exchange system is operating in the heating mode. Other heat exchange systems are configured to energize the reversing valve in the cooling mode (referred to herein as "cooling-mode reversing valve energizing heat exchange systems"), and thus require a controller configured to send an energizing signal to the reversing valve when the heat exchange system is operating in the cooling mode. The controller 200 of the present disclosure enables a technician to install the controller 200 or replace an already installed heat pump controller without regard to the manufacturer of the heat exchange system in which the heat pump controller 200 is to be installed.

More specifically, the computing device 230 is selectively configurable between a cooling-mode reversing valve energizing mode and a heating-mode reversing valve energizing mode. The user interface 250 enables a user to select between the different reversing valve energizing modes by displaying, using the display device 252, a visual indicator corresponding to each of the reversing valve energizing modes, and receiving, using the input interface 254, a user selection corresponding to one of the reversing valve energizing modes. The computing device 230 (specifically, the processor 304) stores the user selection in the storage device 302.

Depending upon the user-selected reversing valve energizing mode, the processor 304 controls actuation of the reversing valve 116 by outputting an energizing signal to the reversing valve 116 in one of the heating mode or cooling mode, and outputting a de-energizing signal to the reversing valve 116 in the other of the heating or cooling mode.

When the cooling-mode reversing valve energizing mode is selected, the processor 304 outputs a de-energizing signal to the reversing valve 116 when the processor 304 determines the conditions for initiating a defrost cycle are satisfied. The reversing valve 116 actuates and changes the flow of refrigerant such that the heat exchange system 100 is operating in a cooling mode. To terminate the defrost cycle, the processor 304 outputs an energizing signal to the reversing valve 116 to actuate the reversing valve 116 and return the refrigerant flow to its original direction.

When the heating-mode reversing valve energizing mode is selected, the processor 304 outputs an energizing signal to the reversing valve 116 when the processor 304 determines the conditions for initiating a defrost cycle are satisfied. The reversing valve 116 actuates and changes the flow of refrigerant such that the heat exchange system 100 is operating in a cooling mode. To terminate the defrost cycle, the processor 304 outputs a de-energizing signal to the reversing valve 116 to actuate the reversing valve 116 and return the refrigerant flow to its original direction.

The controller 200 of the present disclosure may also be configured to receive and store user selections corresponding to a plurality of user-configurable settings in addition to a defrost mode and a reversing valve energizing mode. Additional user-configurable settings include, but are not limited to, a defrost enable temperature, a defrost termination temperature, a defrost cycle time, a short cycle time, a reversing valve shift delay time, a maximum defrost time, an auxiliary heater lockout temperature, a compressor cutout temperature, a random start delay time, a low pressure switch setting, a high pressure switch setting, and a brown-out protection setting.

The controller 200, and, more specifically, the user interface 250, is configured to display the user configurable settings, and receive a user selection of one of the user configurable settings. For each user-configurable setting, the controller 200, and, more specifically, the user interface 250, is configured to display a plurality of user-selectable options corresponding to one of the user-configurable settings, and receive a user-selection of one of the plurality of options.

The defrost enable temperature setting enables a user to select an external heat exchanger threshold temperature above which the controller 200 will not initiate a defrost cycle. More specifically, when the temperature of the external heat exchanger 104 is above the selected threshold temperature, the controller 200, and, more specifically, the processor 304, will not execute the defrost mode algorithms to determine if a defrost cycle is needed. For example, when the temperature of the external heat exchanger 104 is above the selected threshold temperature, the controller will not monitor ambient air temperature and/or compressor run time. Suitable user-selectable options corresponding to the defrost enable temperature setting include degrees in Fahrenheit or Celsius. In the illustrated embodiment, the controller 200 displays the user-selectable options corresponding to the defrost enable temperature setting in degrees Fahrenheit.

The defrost termination temperature setting enables a user to select an external heat exchanger threshold temperature above which the controller 200 will terminate a defrost cycle. When a defrost cycle is initiated, the processor 304 monitors the temperature of the external heat exchanger 104 based on a signal received from the first sensor 122. When the temperature of the external heat exchanger 104 exceeds the user-selected threshold temperature, the processor 304 terminates the defrost cycle by sending a signal to the reversing valve 116. Suitable user-selectable options corresponding to the defrost termination temperature setting include degrees in Fahrenheit or Celsius. In the illustrated embodiment, the controller 200 displays the user-selectable options corresponding to the defrost termination temperature setting in degrees Fahrenheit.

The defrost cycle time setting enables a user to select a threshold time value for the timed defrost mode. The processor 304 stores the user-selected threshold time value in the storage device 302, and recalls the time value when determining whether the time condition has been satisfied for the timed defrost mode. When the processor 304 determines that the user-selected threshold time value is satisfied, the processor 304 receives a signal from the first sensor 122 and determines whether the temperature of the external heat exchanger 104 is below a threshold temperature value. If the temperature of the external heat exchanger 104 is below the threshold temperature, the processor 304 initiates the defrost cycle. Alternatively, when the processor 304 determines that the user-selected threshold time value is satisfied, the processor initiates a defrost mode. As described above, the threshold time value may correspond to the amount of time since the termination of a previous defrost cycle, or the aggregate run time of the compressor 108 since the termination of a previous defrost cycle. Suitable user-selectable options corresponding to the defrost cycle time setting include units of time in seconds, minutes, hours, or any other suitable unit of time. In the illustrated embodiment, the controller 200 displays the user-selectable options corresponding to the defrost cycle time setting in minutes.

The short cycle time setting enables a user to select a minimum time period between compressor on and off cycles to prevent damage to the compressor 108 resulting from rapid on and off cycling. The processor 304 stores the user-selected time period in the storage device 302. When the compressor 108 is de-energized (e.g., following a heating or cooling cycle), the controller 200 monitors the elapsed time from the time the compressor 108 was de-energized and does not energize the compressor 108 until the selected minimum time period has elapsed, even if a signal is received (e.g., from the thermostat) to initiate a heating or cooling cycle. The controller 200 may also be configured to activate the short cycle time delay upon being powered on to prevent rapid cycling of the compressor 108 resulting from unexpected interruptions in power supply. Suitable user-selectable options corresponding to the short cycle time setting include units of time in seconds, minutes, hours, or any other suitable unit of time. In the illustrated embodiment, the controller 200 displays the user-selectable options corresponding to the short cycle time setting in minutes.

The reversing valve shift delay time setting enables a user to select a compressor delay time during which the compressor 108 does not run to reduce compressor noise when the reversing valve 116 is actuated. The processor 304 stores the user-selected compressor delay time in the storage device 302. When the controller 200 determines the conditions for initiating a defrost cycle are satisfied, the controller 200 outputs a signal to the compressor 108 to turn the compressor off. When the compressor delay time has elapsed, the controller 200 outputs a second signal to the compressor 108 to re-energize the compressor 108. Suitable user-selectable options corresponding to the reversing valve shift delay time setting include units of time in seconds, minutes, hours, or any other suitable unit of time. In the illustrated embodiment, the controller 200 displays the user-selectable options corresponding to the reversing valve shift delay time setting in seconds.

The maximum defrost time setting enables a user to select a maximum time limit for a defrost cycle initiated by the controller 200. The processor 304 stores the user-selected time limit in the storage device 302, and monitors the elapsed time of a defrost cycle. If the elapsed time of the defrost cycle equals or exceeds the user-selected time limit, the processor 304 terminates the defrost cycle. Suitable user-selectable options corresponding to the maximum defrost time setting include units of time in seconds, minutes, hours, or any other suitable unit of time. In the illustrated embodiment, the controller 200 displays the user-selectable options corresponding to the maximum defrost time setting in minutes.

The auxiliary heater lockout temperature setting enables a user to select an ambient air threshold temperature above which the controller 200 will not energize the auxiliary heater 120. The processor 304 stores the user-selected auxiliary heater lockout temperature in the storage device 302, and monitors the ambient air temperature via signals received from the second sensor 124. If the controller 200 determines that the ambient air temperature is above the user-selected auxiliary heater lockout temperature, the controller 200 does not energize the auxiliary heater 120. Suitable user-selectable options corresponding to the auxiliary heater lockout temperature setting include degrees in Fahrenheit or Celsius, and a disabled option, in which the auxiliary heater lockout temperature function is disabled. In the illustrated embodiment, the controller 200 displays the user-selectable temperature options corresponding to the auxiliary heater lockout temperature setting in degrees Fahrenheit.

The compressor cutout temperature setting enables a user to select a threshold ambient air temperature below which the compressor 108 will not be energized during a heating cycle. Below certain temperatures (e.g., 5° F.), some heat exchange systems operating in a heating mode supply heat more efficiently by using an auxiliary heater rather than using a compressor to pump refrigerant through a heat exchange system. The compressor cutout temperature setting enables a user to specify a temperature below which the heat exchange system 100 will not use the compressor 108 to supply heat to a temperature controlled environment, but will instead use an auxiliary heater, such as the auxiliary heater 120, to supply heat to the temperature controlled environment. The processor 304 stores the user-selected threshold ambient air temperature in the storage device 302. When the controller 200 receives a demand signal from the thermostat 118 to initiate a heating cycle, the processor 304 measures the ambient air temperature based on signals received from the second sensor 124, and compares the user-selected threshold ambient air temperature with the measured ambient air temperature. If the measured ambient air temperature is below the user-selected threshold ambient air temperature, the controller 200 does not energize the compressor 108. Further, the controller 200 is configured to energize the auxiliary heater 120 to supply heat to a temperature controlled environment when the measured ambient air temperature is below the user-selected threshold ambient air temperature. Suitable user-selectable options corresponding to the compressor cutout temperature setting include degrees in Fahrenheit or Celsius, and a disabled option, in which the compressor cutout temperature function is disabled. In the illustrated embodiment, the controller 200 displays the user-selectable temperature options corresponding to the compressor cutout temperature setting in degrees Fahrenheit.

The random start delay time setting enables a user to enable or disable a random start delay time function that prevents the compressor 108 from being energized during a random delay time period immediately following the controller 200 being powered on (e.g., following a brownout or blackout). In one suitable embodiment, when the random start delay time function is enabled, the processor 304 generates a random delay time period immediately following the controller 200 being powered on, and stores the generated random delay time period in the storage device 302. The controller 200 monitors the elapsed time from the controller 200 being powered on, and does not energize the compressor 108 until the random delay time period has elapsed, even if a signal is received (e.g., from the thermostat) to initiate a heating, cooling, or defrost mode. Suitable user-selectable options corresponding to the random start delay time setting include an enabled option, in which the random start delay time function is enabled, and a disabled option, in which the random start delay time function is disabled.

The low pressure switch setting enables a user to enable or disable a low pressure switch function that disables compressor operation when the pressure of the refrigerant is below a threshold pressure. The low pressure switch setting is adapted for use with heat exchange systems including one or more refrigerant pressure sensors configured to monitor the pressure of the refrigerant within the heat exchange system. Suitable user-selectable options corresponding to the low pressure switch setting include an enabled option, in which the low pressure switch function is enabled, and a disabled option, in which the low pressure switch function is disabled.

The high pressure switch setting enables a user to enable or disable a high pressure switch function that disables compressor operation when the pressure of the refrigerant is above a threshold pressure. The high pressure switch setting is adapted for use with heat exchange systems including one or more refrigerant pressure sensors configured to monitor the pressure of the refrigerant within the heat exchange system. Suitable user-selectable options corresponding to the high pressure switch setting include an enabled option, in which the high pressure switch function is enabled, and a disabled option, in which the high pressure switch function is disabled.

The brownout protection setting enables a user to enable or disable a brownout protection function configured to prevent components of the heat exchange system 100 from operating without a sufficient power supply. When the brownout protection function is enabled, the controller 200 monitors the available power supply by, for example, monitoring the voltage supplied to one or more components of the heat exchange system 100. If the controller 200 determines that the available power supply is inadequate for components of the heat exchange system to operate (e.g., the blowers 112, 114, 126 and the compressor 108), the controller prevents the components from being energized, or de-energizes such components if they are already energized. Suitable user-selectable options corresponding to the brownout protection setting include an enabled option, in which the brownout protection function is enabled, and a disabled option, in which the brownout protection function is disabled.

The below Table I provides an illustrative example of suitable user-configurable settings, suitable user-selectable options corresponding to each user-configurable setting, and suitable visual indicators displayed by the user interface 250 (more specifically, the display device 252) corresponding to the user-configurable settings and the user-selectable options.

TABLE I

| User-Configurable Setting | Visual Indicator | User Selectable Options | Visual Indicators |
|---|---|---|---|
| Defrost Mode | dF | Demand Defrost or Timed Defrost | d, t |
| Defrost Enable Temperature | Et | Degrees Fahrenheit | 30, 31, 32, 33, 34, 35, 36 |
| Defrost Termination Temperature | tt | Degrees Fahrenheit | 50, 60, 65, 70, 75, 80, 90, 100 |
| Defrost Cycle Time | dc | Minutes | 30, 50, 60, 70, 90, 120 |
| Short Cycle Time | SS | Minutes | 0, 3, 5 |
| Reversing Valve Energizing Mode | r | Cooling-mode reversing valve energizing mode (o) or heating-mode reversing valve energizing mode (b) | o, b |
| Reversing Valve Shift Delay Time | Sd | Seconds | 0, 12, 30 |
| Maximum Defrost Time | dt | Minutes | 8, 10, 14 |
| Auxiliary Heater Lockout Temperature | hL | Degrees Fahrenheit, disabled | 0, 10, 15, 20, 25, 30, 35, 40, of |
| Compressor Cutout Temperature | Lt | Degrees Fahrenheit, disabled | −10, 0, 10, 15, 20, 25, 30, 35, of |
| Random Start Delay Time | rt | Enabled or disabled | on, of |
| Low Pressure Switch | LP | Enabled or disabled | on, of |
| High Pressure Switch | HP | Enabled or disabled | on, of |
| Brownout Protection | BO | Enabled or disabled | on, of |

The controller 200 of the present disclosure may also be configured to store a plurality of pre-configurations of the user-configurable settings. In one embodiment, for example, the storage device 302 includes a plurality of pre-configurations of the user-configurable settings, where each pre-configuration corresponds to one of a plurality of heat exchange system manufacturers' default settings. Examples of heat exchange system manufacturers to which the pre-configurations may correspond include, but are not limited to, Carrier Corporation ("Carrier") of Farmington, Conn., Goodman Manufacturing Company, L.P., ("Goodman") of Houston, Tex., Lennox International Inc. ("Lennox") of Richardson, Tex., Trane ("Trane"), a subsidiary of Ingersoll Rand of Dublin, Ireland, Rheem Manufacturing Company ("Rheem") of Atlanta, Ga., York ("York"), a subsidiary of Johnson Controls, Inc. of Milwaukee, Wis., and Nordyne LLC ("Nordyne") of O'Fallon, Miss.

The controller 200 may also be configured to store a user-defined pre-configuration, referred to as a "custom" pre-configuration. For example, a user may select, using the user interface 250, one of the plurality of user-selectable options for each user-configurable setting, and save the user-selections as a custom pre-configuration in the storage device 302. When the controller 200 is installed in a heat exchange system, a user may select the custom pre-configuration using the user interface 250 to set up the controller 200 for operation.

The ability to select between a plurality of pre-configurations of user-configurable settings may be considered an additional "user-configurable setting," and is hereinafter referred to as a "quick setup" setting. Suitable user selectable options corresponding to the quick setup setting may include numeric characters, alphabetic characters, alphanumeric characters, symbols, or any other visual indicator that enables the controller 200 to function as described herein. The below Table II provides an illustrative example of suitable visual indicators corresponding to the quick setup setting and the user-selectable options corresponding to the quick setup setting.

TABLE II

| User-Configurable Setting | Visual Indicator | User Selectable Options | Visual Indicator |
|---|---|---|---|
| Quick Setup | OE | Carrier | 1 |
| | | Goodman | 2 |
| | | Lennox | 3 |
| | | Trane | 4 |
| | | Rheem | 5 |
| | | York | 6 |
| | | Nordyne | 7 |
| | | Custom | 8 |

The below Table III provides an illustrative example of suitable default settings for the above-identified heat exchange system manufacturers, as well as an example of a user-defined custom pre-configuration.

TABLE III

| User Selectable Options | Defrost Mode | Defrost Cycle Time | Short Cycle Time | Reversing Valve Energizing Mode | Reversing Valve Shift Delay (seconds) | Maximum Defrost Time | Defrost Enable Temperature | Defrost Terminate Temperature |
|---|---|---|---|---|---|---|---|---|
| Carrier | Timed | 90 min | 5 min | O | 0 sec | 10 min | 30° F. | 65° F. |
| Goodman | Timed | 30 min | 5 min | O | 30 sec | 10 min | 35° F. | 70° F. |
| Lennox | Demand | n/a | 5 min | O | 30 sec | 14 min | 35° F. | 50° F. |
| Trane | Demand | n/a | 0 min | O | 12 sec | 14 min | 36° F. | 50° F. |
| Rheem | Demand | n/a | 5 min | B | 30 sec | 14 min | 35° F. | 70° F. |
| York | Demand | n/a | 5 min | O | 30 sec | 8 min | 31° F. | 80° F. |
| Nordyne | Demand | n/a | 3 min | O | 30 sec | 14 min | 35° F. | 70° F. |
| Custom | Demand | n/a | 5 min | O | 30 sec | 14 min | 35° F. | 70° F. |

As noted above, the controller 200 of the present disclosure is selectively configurable between a plurality of operating modes using the computing device 230 and the user interface 250 such that a technician may install the controller 200 in a variety of different heat exchange systems without regard to the heat exchange system manufacturer, and configure the controller 200 to operate with the heat exchange system in which the controller is installed.

To install the controller 200 in the heat exchange system 100 illustrated in FIG. 1, the first input connector 202 is coupled to the first sensor 122, the second input connector 204 is coupled to the second sensor 124, and the reversing valve output connector 210 is coupled to the reversing valve 116. In the illustrated embodiment, the controller 200 is also coupled to the compressor 108, the thermostat 118, and the auxiliary heater 120. The controller 200 is coupled to a power supply (not shown), and one of the user-selectable defrost modes is selected using the user interface 250. As noted above, suitable user-selectable defrost modes include a demand defrost mode, in which the computing device 230 initiates a defrost cycle based on a temperature differential between the temperature of the external heat exchanger and the ambient air temperature, and a timed defrost mode, in which the computing device 230 initiates a defrost cycle based on the temperature of the external heat exchanger 104 and an elapsed period of time. One of the user-selectable reversing valve energizing modes is also selected using the user interface 250. As noted above, the user-selectable reversing valve energizing modes include a heating-mode reversing valve energizing mode, in which the computing device 230 outputs an energizing signal to the reversing valve 116 when the heat exchange system 100 is in a heating mode, and a cooling-mode reversing valve energizing mode, in which the computing device 230 outputs an energizing signal to the reversing valve 116 when the heat exchange system 100 is in a cooling mode. The defrost mode and/or the reversing valve energizing mode may be selected by selecting one of the plurality of pre-configurations stored on the storage device 302.

The controller 200 may be installed in heat exchange systems other than the heat exchange system 100 illustrated in FIG. 1, including, but not limited to, a heat exchange system including only one sensor, a heat exchange system including more than two temperature sensors, and a heat exchange system including a sensor other than a temperature sensor, such as a pressure sensor or a photo-optical sensor. Accordingly, the method of installing the controller 200 may include coupling the controller 200 to less than two sensors, or more than two sensors.

The method of installing the controller 200 may also include selecting, using the user interface 250, one of the plurality of user-configurable settings, such as the defrost enable temperature, the defrost termination temperature, or the auxiliary heater lockout temperature.

The controller 200 of the present disclosure may also be used to replace an existing heat pump controller (referred to as a first heat pump controller) in a heat exchange system without regard to the manufacturer of the heat exchange system manufacturer in which the first heat pump controller is installed. The method of replacing the first heat pump controller includes removing the first heat pump controller from the heat exchange system and replacing the first heat pump controller with the heat pump controller 200 without regard to the manufacturer of the heat exchange system in which the first heat pump controller is installed. Replacing the first heat pump controller may include coupling the heat pump controller 200 to the reversing valve of the heat exchange system in which the heat pump controller 200 is being installed. The method may further include selecting one of the plurality of user-selectable defrost modes and/or selecting one of the user-selectable reversing valve energizing modes.

Figure 4:
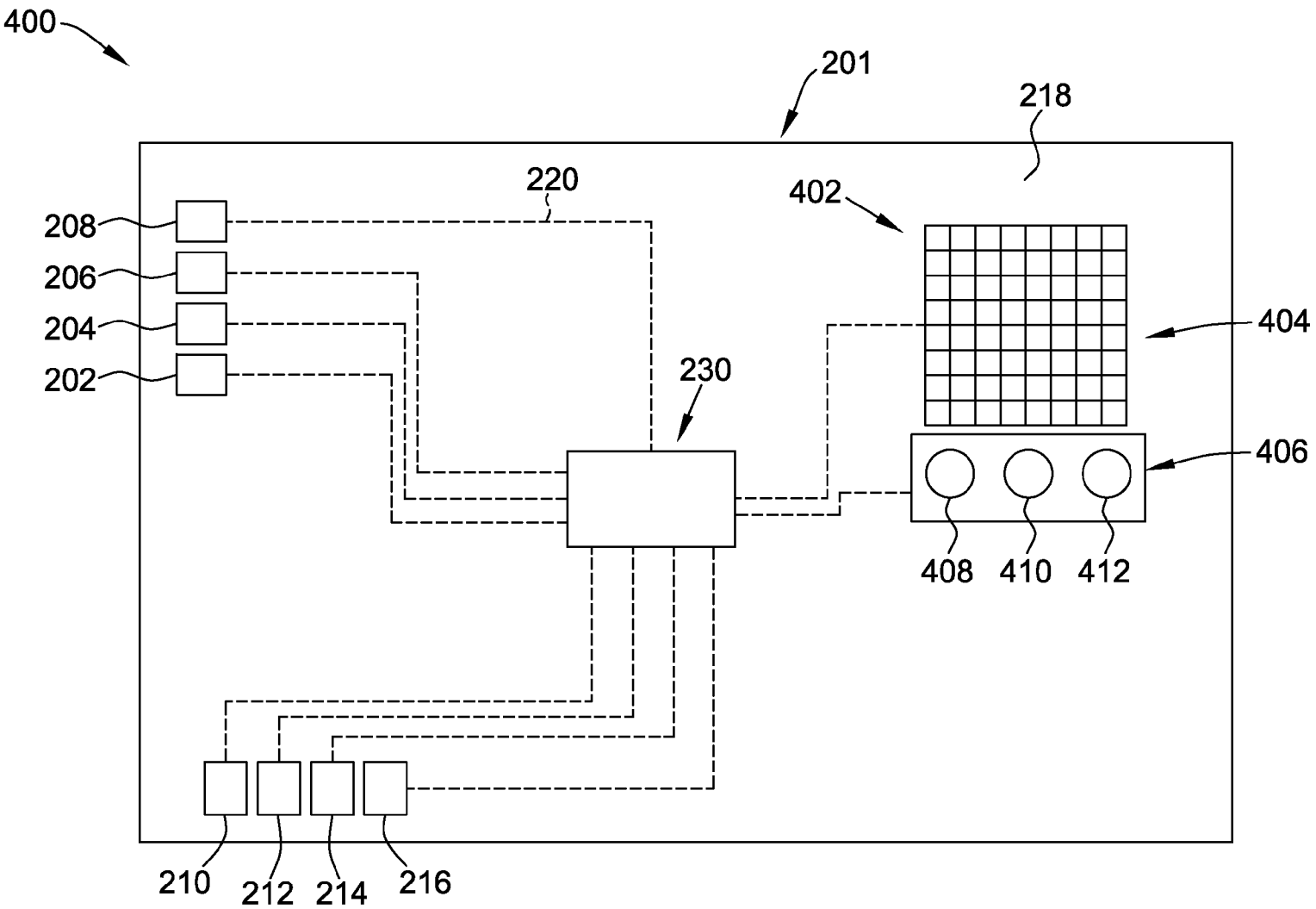
FIG. 4 is a schematic diagram of another embodiment of a heat pump controller suitable for use in the heat exchange system of FIG. 1.

FIG. 4 is a schematic diagram of another embodiment of a heat pump controller, indicated generally at 400, suitable for use in the heat exchange system of FIG. 1. The controller 400 of FIG. 4 is substantially similar to the controller 200 of FIG. 2, except the controller 400 includes a user interface 402 having a multi-orientation display device 404 configured to display information in different orientations.

In the illustrated embodiment, the controller 400 includes the same input connectors 202, 204, 206, 208, the same output connectors 210, 212, 214, 216, and the same computing device 230 as the controller 200 shown and described above with reference to FIGS. 2-3.

The controller 400 also includes a user interface 402 coupled to the computing device 230. The user interface includes a multi-orientation display device 404 and an input interface 406.

The multi-orientation display device 404 is coupled to the computing device 230 (more specifically, the processor 304 (FIG. 3)), and presents information such as user-configurable settings, to a user, such as a technician. In the illustrated embodiment, the multi-orientation display device 404 includes an 8×8 LED matrix display, although the multi-orientation display device 404 may include any suitable display device that enables the controller 400 to function as described herein, such as, for example, a liquid crystal display (LCD), an organic LED (OLED) display, and/or an "electronic ink" display. In this embodiment, the multi-orientation display device 404 is configured to display user-configurable settings, a plurality of options corresponding to each user-configurable setting, and user-selectable pre-configurations of the user-configurable settings. Further, the multi-orientation display device 404 is configured to display information in different orientations based on a user selection.

The input interface 406 is coupled to the computing device 230 (more specifically, the processor 304) and is configured to receive input from a user. In the illustrated embodiment, the input interface 404 includes a plurality of push buttons 408, 410, 412 to receive input from a user, although the input interface 406 may include any suitable input device that enables controller 400 to function as described herein.

In this embodiment, the controller 400 includes an additional user-configurable setting referred to as a display orientation direction setting. The user interface 402 is configured to display the display orientation direction setting as one of the user-configurable settings. The user interface 402 is also configured to display a plurality of user-selectable options corresponding to the display orientation direction, and to receive a user-selection of one of the options. The computing device 230 is configured to store the user-selection, and change the orientation of information displayed by the multi-orientation display 404 in response to the user-selection.

The controller 400 thereby enables a user to change the orientation of information displayed by the multi-orientation display device 404 such that information displayed by the multi-orientation device 404 is displayed in an upright orientation regardless of the orientation in which the controller 400 is installed in a heat exchange system.

The below Table IV provides an illustrative example of suitable user-selectable options, and suitable visual indicators corresponding to the display orientation direction setting and the user-selectable options.

TABLE IV

| User-Configurable Setting | Visual Indicator | User Selectable Options | Visual Indicators |
|---|---|---|---|
| Display Orientation Direction | UP | Orientation directions | ↑ → ← ↓ |

In the illustrated embodiment, the computing device 230 is configured to rotate the orientation of information displayed by the multi-orientation device 404 in 90 degree intervals, although the computing device 230 may be configured to rotate the orientation of information displayed by the multi-orientation device 404 in intervals other than 90 degrees.

The controller 400 may be installed in a heat exchange system in substantially the same manner as the controller 200, described above. In addition, the display orientation direction of the multi-orientation display device 404 may be selected such that information displayed by the multi-orientation display device 404 is an upright configuration regardless of the orientation in which the controller 400 is installed.

Embodiments of the methods and systems described herein achieve superior results as compared to prior methods and systems. For example, unlike known defrost controllers, the heat pump controllers described herein are configured to operate in numerous different types of heat exchange systems. In particular, the heat pump controllers described herein are configurable between a plurality of defrost modes and a plurality of reversing valve energizing modes such that the controllers may be installed in a variety of different heat exchange systems without regard to the heat exchange system manufacturer. As a result, heat exchange systems can be retrofitted with heat pump controllers having modern features, such as demand-defrost modes and auxiliary heater lockout temperature settings, thereby increasing the efficiency of older model heat exchange systems. Further, unlike some known defrost controllers that have limited configurable settings, the heat pump controllers described herein allow a user to select and configure numerous different user-configurable settings using a user-interface having a display device and an input interface. Yet even further, unlike some known defrost controllers that have a fixed display orientation, the heat pump controllers described herein include a multi-orientation display device that can display information in different orientations based on a user-selected display orientation direction such that information displayed by the controller is displayed in an upright configuration regardless of the orientation of the controller.

Example embodiments of heat exchange systems and heat pump controllers are described above in detail. The system and controller are not limited to the specific embodiments described herein, but rather, components of the system and controller may be used independently and separately from other components described herein.

When introducing elements of the present disclosure or the embodiment(s) thereof, the articles "a", "an", "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above constructions and methods without departing from the scope of the disclosure, it is intended that all matter contained in the above description and shown in the accompanying drawing(s) shall be interpreted as illustrative and not in a limiting sense.

What is claimed is:

1. A heat pump controller for use in heat exchange systems of a plurality of heat exchange system manufactures, each one of the heat exchange systems of the plurality of heat exchange system manufactures including an external heat exchanger, a compressor, a reversing valve, and an internal heat exchanger in fluid communication with one another, the heat pump controller comprising:

a computer-readable storage device storing computer executable instructions corresponding to a plurality of user-selectable defrost modes, wherein a first defrost mode of the plurality of user-selectable defrost modes corresponds to a first one of the heat exchange systems of a first one of the plurality of heat exchange system manufacturers, and a second defrost mode of the plurality of user-selectable defrost modes corresponds to a second one of the heat exchange systems of a second one of the plurality of heat exchange system manufacturers;

a user interface, the user interface configured to:

display the plurality of user-selectable defrost modes; and receive a user selection of one of the plurality of user-selectable defrost modes, wherein the one of the plurality of user-selectable defrost modes is selected to control one of the heat exchange systems of one of the plurality of heat exchange system manufacturers; and a computing device coupled to the user interface and the computer-readable storage device, the computing device configured to initiate a defrost cycle for the one of the heat exchange systems of the one of the plurality of heat exchange system manufacturers based on the selected one of the plurality of user-selectable defrost modes.

2. The heat pump controller of claim 1, wherein in the first defrost mode the computing device initiates the defrost cycle based on a temperature of the external heat exchanger and a period of time, and in the second defrost mode the computing device initiates the defrost cycle based on a temperature differential between the temperature of the external heat exchanger and an ambient air temperature surrounding the external heat exchanger.

3. The heat pump controller of claim 2, wherein the period of time is a compressor run time.

4. The heat pump controller of claim 2, wherein in the second defrost mode, the computing device initiates the defrost cycle based on the temperature differential and a compressor run time.

5. The heat pump controller of claim 1 wherein the plurality of user-selectable defrost modes further includes a third defrost mode different than the first and second defrost modes.

6. The heat pump controller of claim 1 wherein each of the plurality of user-selectable defrost modes is mutually exclusive.

7. The heat pump controller of claim 1, wherein the computing device is further configured to output an energizing signal to the reversing valve while the one of the heat exchange systems of the one of the plurality of heat exchange system manufacturers is in one of a heating mode or a cooling mode based on one of a plurality of user-selectable reversing valve energizing modes.

8. The heat pump controller of claim 7, wherein the user interface is further configured to display the plurality of user-selectable reversing valve energizing modes and receive a user selection corresponding to one of the plurality of user-selectable reversing valve energizing modes, wherein the controller energizes the reversing valve in the heating mode in response to a first reversing valve energizing mode of the plurality of reversing valve energizing modes being selected, and energizes the reversing valve in the cooling mode in response to a second reversing valve energizing mode of the plurality of reversing valve energizing modes being selected.

9. The heat pump controller of claim 1, wherein the user interface is further configured to display a plurality of user-configurable settings and receive a user selection corresponding to one of the plurality of user-configurable settings, the plurality of user-configurable settings including at least one of a defrost enable temperature, a defrost termination temperature, and an auxiliary heater lockout temperature.

10. The heat pump controller of claim 1, wherein the computer-readable storage device includes a plurality of user-selectable pre-configurations, each of the plurality of user-selectable pre-configurations corresponding to one of the plurality of heat exchange system manufacturers' default settings.

11. The heat pump controller of claim 10, wherein the user interface is configured to display the plurality of user-selectable pre-configurations and receive a user selection corresponding to one of the plurality of user-selectable pre-configurations.

12. The heat pump controller of claim 1, the computing device further configured to:

determine when to initiate the defrost cycle based on at least one sensed condition associated with the selected one of the plurality of the user-selectable defrost modes, wherein the at least one sensed condition includes at least one of a temperature condition, a pressure condition, a condition sensed by a photo-optical sensor, and a condition sensed by a tactile sensor.

13. The heat pump controller of claim 1, the computing device further configured to:

determine when to initiate the defrost cycle based upon the selected one of the plurality of the user-selectable defrost modes and at least one sensed condition associated with the selected one of the plurality of the user-selectable defrost modes, wherein the at least one sensed condition includes a temperature condition, a pressure condition, a condition sensed by a photo-optical sensor, and a condition sensed by a tactile sensor.

14. A method of installing a heat pump controller for use in heat exchange systems of a plurality of heat exchange system manufacturers, each one of the heat exchange systems of the plurality of heat exchange system manufactures including an external heat exchanger, a compressor, a reversing valve, and an internal heat exchanger in fluid communication with one another, the heat pump controller including a computing device coupled to a user interface and a computer-readable storage device, the method comprising:

coupling the computing device to the reversing valve;

displaying, using the user interface, a plurality of user-selectable defrost modes, wherein the computer-readable storage device stores computer executable instructions corresponding to the plurality of user-selectable defrost modes, and wherein a first defrost mode of the plurality of user-selectable defrost modes corresponds to a first one of the heat exchange systems of a first one of the plurality of heat exchange system manufacturers, and a second defrost mode of the plurality of user-selectable defrost modes corresponds to a second one of the heat exchange systems of a second one of the plurality of heat exchange system manufacturers;

selecting, using the user interface, one of the plurality of user-selectable defrost modes, wherein the one of the plurality of user-selectable defrost modes is selected to control one of the heat exchange systems of one of the plurality of heat exchange system manufacturers, and wherein the heat pump controller initiates a defrost cycle for the one of the heat exchange systems of the one of the plurality of heat exchange system manufacturers based on the selected one of the plurality of user-selectable defrost modes.

15. The method of claim 14, wherein in the first defrost mode the computing device initiates the defrost cycle based on a temperature of the external heat exchanger and a period of time, and in the second defrost mode the computing device initiates the defrost cycle based on a temperature differential between the temperature of the external heat exchanger and an ambient air temperature surrounding the external heat exchanger.

16. The method of claim 15, wherein in the second defrost mode, the computing device initiates the defrost cycle based on the temperature differential and a compressor run time.

17. The method of claim 14, wherein the plurality of user-selectable defrost modes further includes a third defrost mode different from the first and second defrost modes.

18. The method of claim 14, further comprising selecting, using the user interface, one of a plurality of user-selectable reversing valve energizing modes.

19. The method of claim 18, wherein the plurality of user-selectable reversing valve energizing modes includes a first energizing mode and a second energizing mode, wherein in the first energizing mode the computing device energizes the reversing valve when the one of the heat exchange systems of the one of the plurality of heat exchange system manufacturers is in a heating mode, and in the second energizing mode the computing device energizes the reversing valve when the one of the heat exchange systems of the one of the plurality of heat exchange system manufacturers is in a cooling mode.

20. The method of claim 14, wherein the computer-readable storage device includes a plurality of user-selectable pre-configurations, each of the plurality of user-selectable pre-configurations corresponding to one of the plurality of heat exchange system manufacturers' default settings, and wherein selecting one of the plurality of user-selectable defrost modes includes selecting one of the plurality of user-selectable pre-configurations.

21. A heat pump controller for use in heat exchange systems of a plurality of heat exchange system manufactures, each one of the heat exchange systems of the plurality of heat exchange system manufactures including an external heat exchanger, a compressor, a reversing valve, and an internal heat exchanger in fluid communication with one another, the heat pump controller comprising:

a computer-readable storage device storing computer executable instructions corresponding to a plurality of user-selectable defrost modes, wherein a first defrost mode of the plurality of user-selectable defrost modes corresponds to a first one of the heat exchange systems of a first one of the plurality of heat exchange system manufacturers, and a second defrost mode of the plurality of user-selectable defrost modes corresponds to a second one of the heat exchange systems of a second one of the plurality of heat exchange system manufacturers;

a user interface configured to:

display the plurality of user-selectable defrost modes, and receive a user selection of one of the plurality of user-selectable defrost modes, wherein the one of the plurality of user-selectable defrost modes is selected to control one of the heat exchange systems of one of the plurality of heat exchange system manufacturers; and a computing device configured to:

initiate a defrost cycle associated with the selected one of the plurality of user-selectable defrost modes in response to the user selection for the one of the heat exchange systems of the one of the plurality of heat exchange system manufacturers.

* * * * *